US008616354B2

(12) United States Patent
Azirian

(10) Patent No.: US 8,616,354 B2
(45) Date of Patent: Dec. 31, 2013

(54) CONFIGURABLE BRIEFCASE DESKTOP

(76) Inventor: Vatche Azirian, Los Angeles, CA (US)

( * ) Notice: Subject to any disclaimer, the term of this patent is extended or adjusted under 35 U.S.C. 154(b) by 1164 days.

(21) Appl. No.: 12/462,031

(22) Filed: Jul. 27, 2009

(65) Prior Publication Data

US 2011/0017563 A1 Jan. 27, 2011

(51) Int. Cl.
*A47B 85/00* (2006.01)

(52) U.S. Cl.
USPC ..... 190/11; 190/1; 190/8; 206/320; 206/373; 206/45.24; 414/462; 414/542; 414/607; D6/429; D6/480; D6/426; 312/241; 312/231

(58) Field of Classification Search
USPC ..... 190/1, 15 B, 11, 15 R; 206/320, 373, 206/45.24; 224/413, 509, 524; 280/87.051, 280/30, 35; 312/231, 241, 315.5; 414/462, 414/495, 541, 542, 607; D6/429
See application file for complete search history.

(56) References Cited

U.S. PATENT DOCUMENTS

| | | | | | |
|---|---|---|---|---|---|
| 724,985 | A | * | 4/1903 | Wohlrabe | 190/15 R |
| 893,694 | A | | 7/1908 | Allenson | |
| 1,762,580 | A | * | 6/1930 | Menk | 190/8 |
| 1,770,156 | A | * | 7/1930 | Hoyer, Jr. et al. | 312/351.5 |
| 2,160,958 | A | * | 6/1939 | Critchlow | 108/33 |
| 2,603,011 | A | * | 7/1952 | Plumb | 108/25 |
| 3,912,048 | A | * | 10/1975 | Manning | 414/541 |
| 4,391,345 | A | * | 7/1983 | Paul | 182/141 |
| 4,455,948 | A | * | 6/1984 | Torres | 108/44 |
| 4,576,392 | A | * | 3/1986 | Quinlan, Jr. | 280/87.051 |
| 4,595,086 | A | | 6/1986 | Simpson | |
| 4,790,416 | A | | 12/1988 | Baker | |
| 4,941,797 | A | * | 7/1990 | Smillie, III | 414/462 |
| 5,281,019 | A | | 1/1994 | Rodeck | |
| 5,346,355 | A | * | 9/1994 | Riemer | 414/542 |
| 6,036,011 | A | | 3/2000 | DeCurtis et al. | |
| 6,068,355 | A | | 5/2000 | Thorp | |
| 6,811,006 | B1 | | 11/2004 | Mundle | |
| 7,246,784 | B1 | * | 7/2007 | Lopez | 248/588 |
| 7,327,562 | B2 | * | 2/2008 | Littlepage | 361/679.55 |
| 2002/0023811 | A1 | | 2/2002 | Silvano | |
| 2002/0063072 | A1 | | 5/2002 | Pham | |
| 2004/0226791 | A1 | | 11/2004 | Levy | |

* cited by examiner

*Primary Examiner* — Anthony Stashick
*Assistant Examiner* — Cynthia Collado
(74) *Attorney, Agent, or Firm* — James E. Brunton

(57) ABSTRACT

A configurable briefcase desktop having two generally planar support columns, each support column having a fixed length section and an extendable section. The extendable section of each support column is comprised of a scissors linkage and an elongated foot member. The elongated foot member provides improved load distribution across the surface supporting the invention. Embodiments typically include a fold lock mechanism to releasably lock each support column in its folded configuration. Other embodiments have a support stiffening mechanism adapted to yieldably resist movement of its respective support member from its support configuration. Further embodiments comprise at least one load sensor system to provide a warning signal when the extendable section of a support column is in extended configuration and subjected to a compression force in excess of a predetermined amount. In some embodiments the fold lock mechanism and support stiffening mechanism of a particular support column may be mechanically ganged.

13 Claims, 13 Drawing Sheets

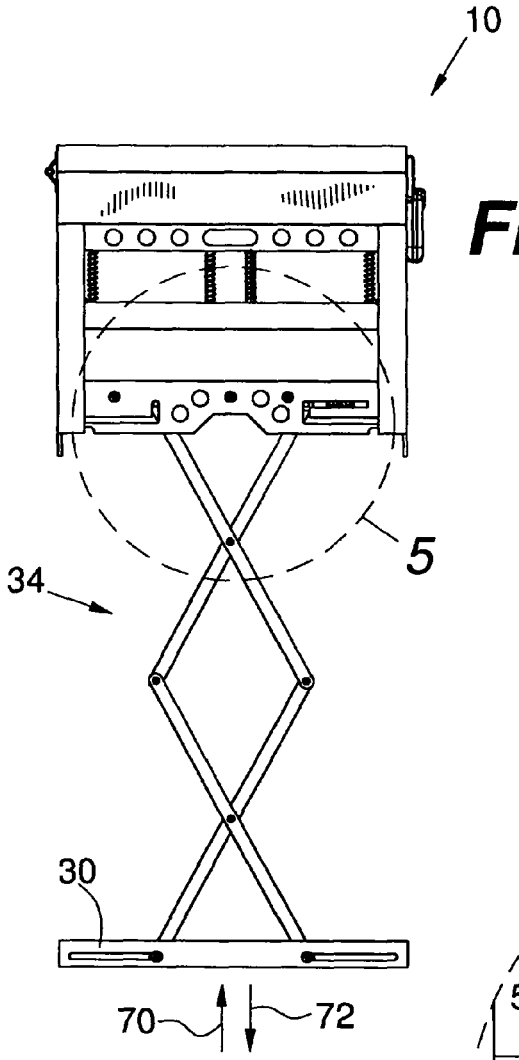
Fig. 4
Fig. 5
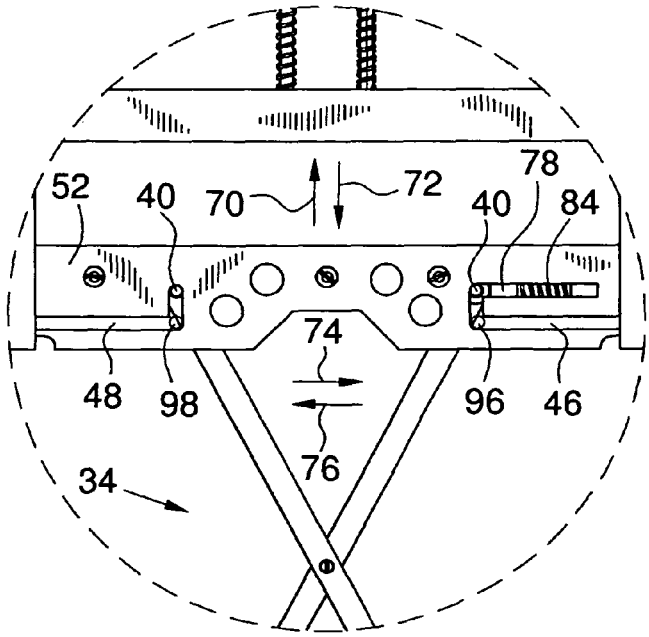

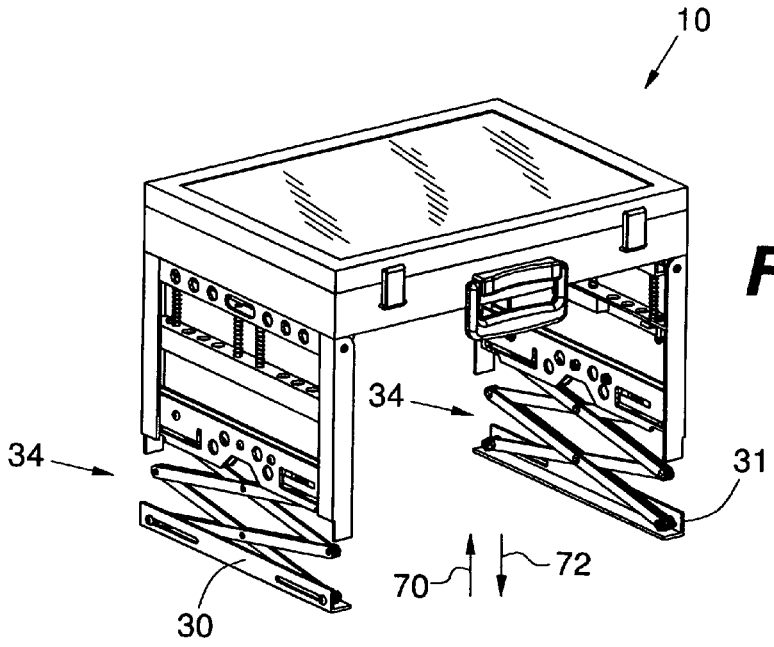
Fig. 6
Fig. 7
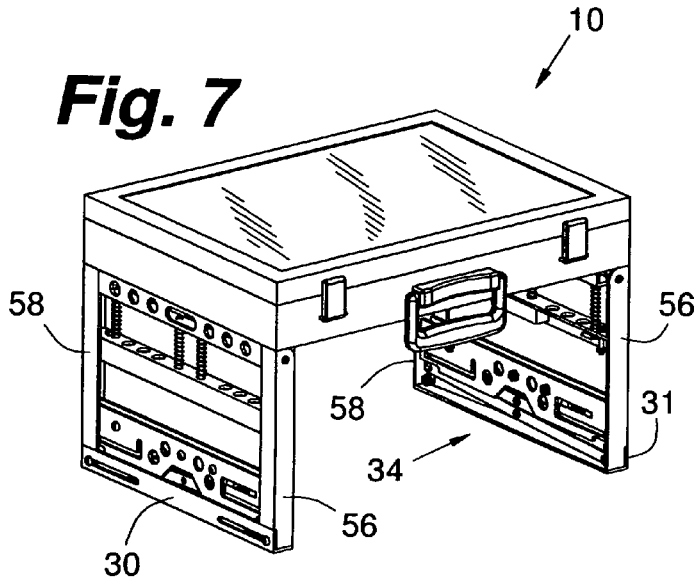

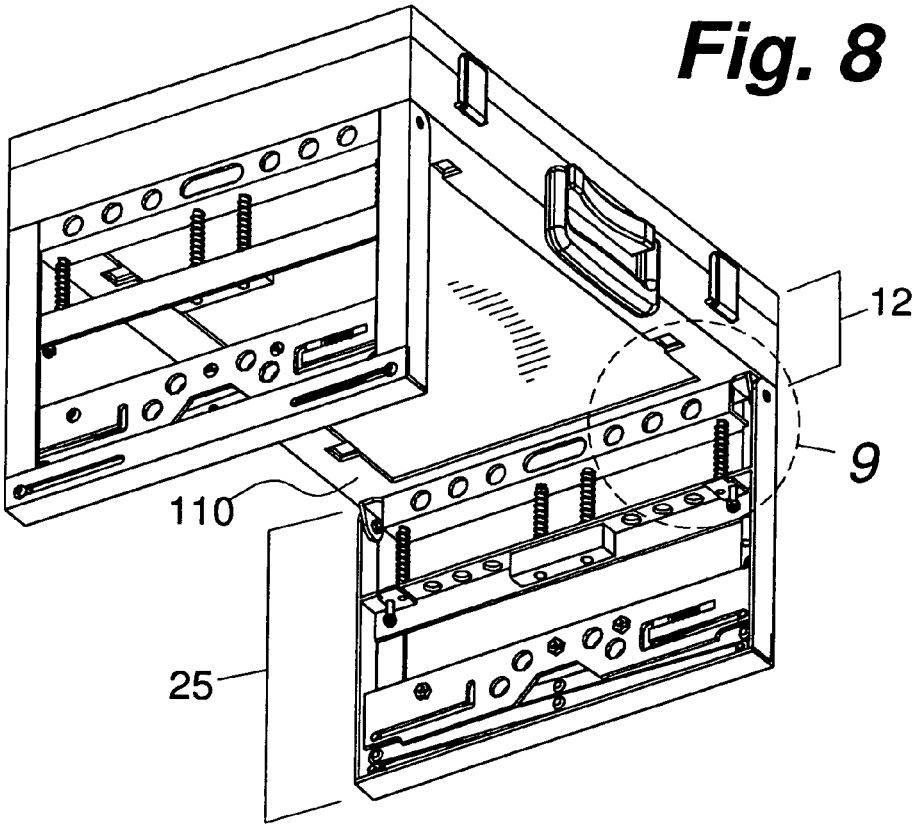
Fig. 8
Fig. 9
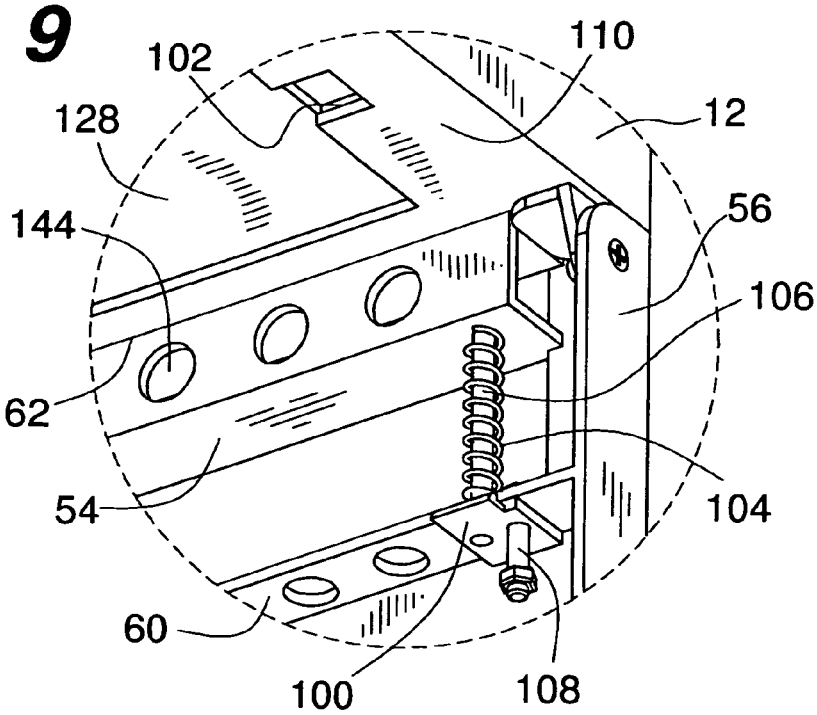

Fig. 12
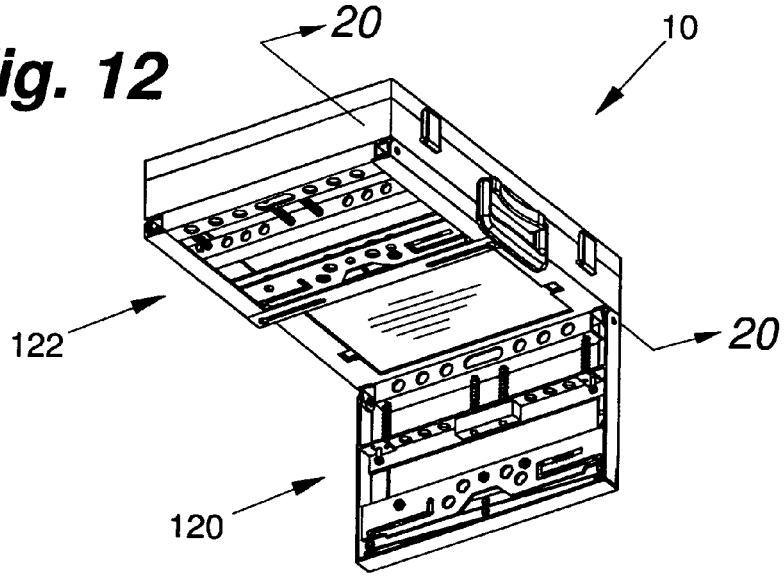
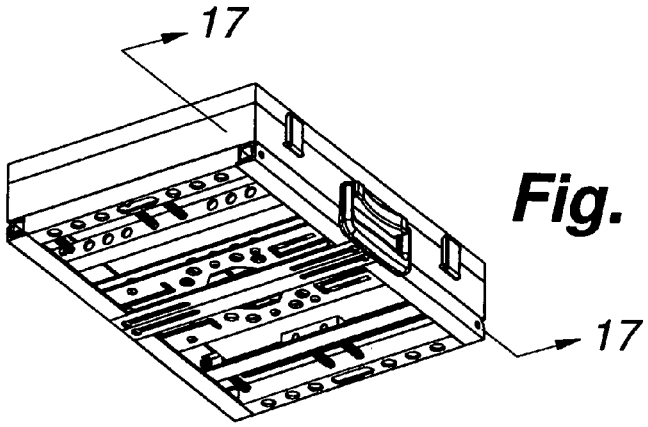
Fig. 13
Fig. 14
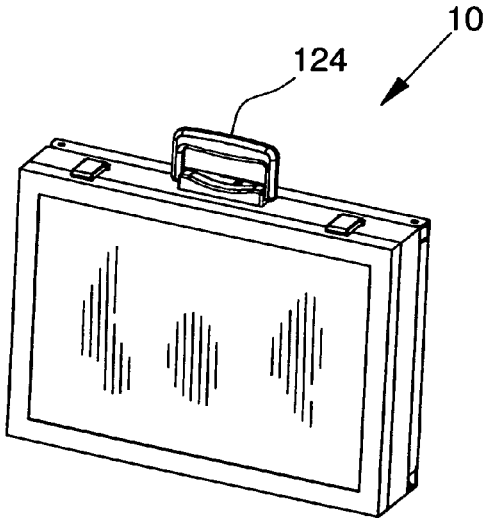

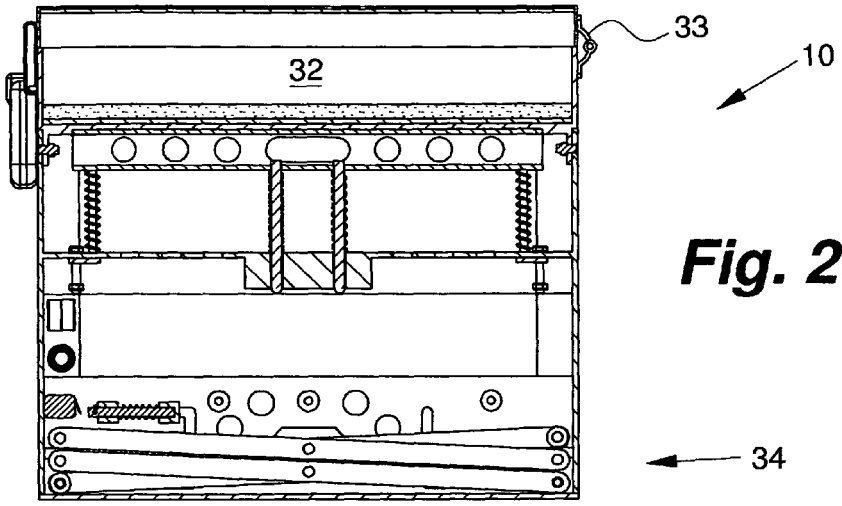
Fig. 23
Fig. 24
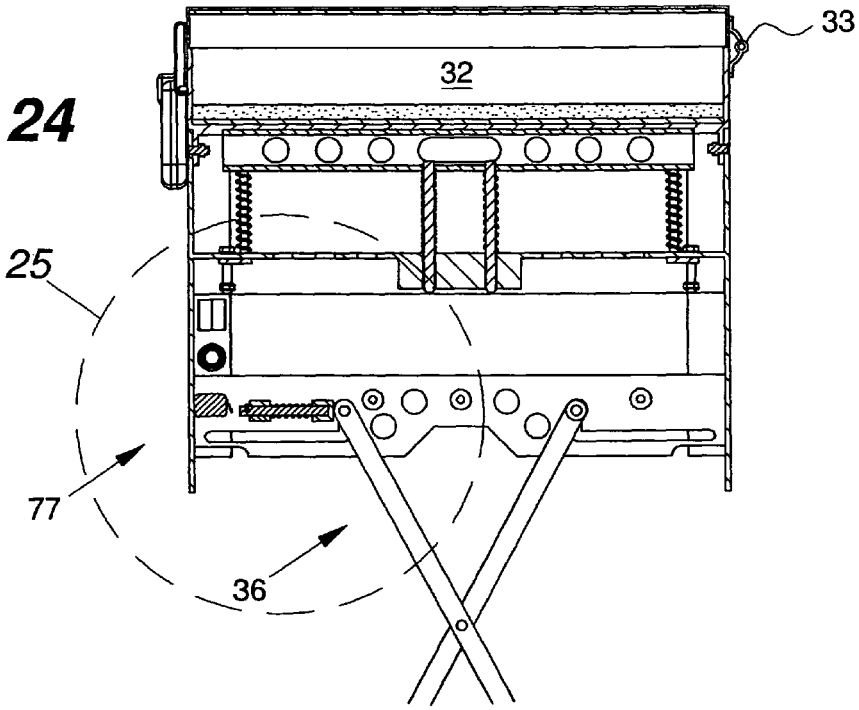

CONFIGURABLE BRIEFCASE DESKTOP

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention relates generally to portable desktops and storage devices. More particularly, the invention concerns a lightweight briefcase desktop with supports that can be placed in varying configurations to adjust support height and improve transportability. Further embodiments include a load sensor to alert a user when a support column is being subjected to an unsafe support load.

2. Description of Related Art Including Information Disclosed Under 37 CFR 1.97 and 1.98

Portable briefcases and desktops of numerous designs exist in the prior art. Common features of most such devices include a generally box shaped body with an accessible internal cavity, and supports of various types which may be either collapsible or removable to aid in the transportability of the device.

Typical examples of portable desktop carrying cases are illustrated in Thorp U.S. Pat. No. 6,068,355, DeCurtis et al. U.S. Pat. No. 6,036,011, Allenson U.S. Pat. No. 893,694, Simpson U.S. Pat. No. 4,595,086, and Littlepage U.S. Pat. No. 7,327,562, each of which is hereby incorporated by reference as if fully set forth herein.

A common disadvantage in the foregoing and other existing portable briefcase desktops is the tendency for their supports to deliver the full weight of the device through relatively small footprints placed in direct contact with the support surface. The resulting point loads can cause damage to such support surfaces as carpeting, padding and other surfaces that are susceptible to damage from stress concentrations. There is a need for improvement in this area.

As technology has allowed more employees to work from home, there is a greater need for a device capable of providing a stable working surface with a convenient storage compartment that can be configured to accommodate work in a variety of locations and working positions. In particular, the support structure of such a device should be configurable to provide support for someone working from a chair, on a couch or even in bed.

People frequently place weight on supporting devices in excess of what those devices are designed to support. Portable working surfaces are particularly vulnerable to collapse under such circumstances given that their support structures are generally lighter and less sturdy than their less-portable counterparts. A system capable of providing a warning when the load capacity of the briefcase desktop's support structure has been exceeded would help prevent such a collapse.

Accordingly, there exists a need for a lightweight, portable briefcase desktop that is configurable for multiple support heights, provides a warning when its support capacity has been exceeded and distributes weight over a larger footprint when supports are in use.

BRIEF SUMMARY OF THE INVENTION

Embodiments of the configurable briefcase desktop according to the present invention comprise a body which includes two spaced apart generally opposed sides, each side having an associated pivot axis. The pivot axes extend generally parallel to one another and are spaced apart by a distance. A readily accessible storage cavity is generally included as well. Embodiments further include two generally planar support columns, each being mounted generally around one of the pivot axes and extending generally parallel to the pivot axis to which it is mounted. The support columns are adapted to being rotated between folded and support configurations. Each support column includes a fixed length and an extendable section. The extendable sections are each comprised of a scissors linkage and an elongated foot member.

The scissors linkages of embodiments are adapted to extend between retracted and extended configurations, wherein they each extend generally parallel to their respective support column and generally perpendicular to the pivot axis about which their respective support column rotates. Each scissor linkage is further adapted such that when it is in a fully retracted configuration, its respective support column has an overall length that is no more than approximately one-half of the distance between the pivot axes. As a result of this adaptation, when both support columns are in their fully folded and fully retracted configurations, the support columns are generally located in approximately a common plane. When the support columns are both in their support configuration, they extend generally parallel to one another and are spaced apart by at least approximately the distance separating the pivot axes.

The scissor linkages each have a first end and a second end, the first end being operably joined to the fixed length section of its respective support columns, and the second end being connectedly associated with its respective elongated foot member. Each elongated foot member is further adapted to rest on a flat surface.

According to some embodiments, at least one fold lock mechanism is included which is adapted to releasably lock its respective support column in folded configuration. Typically, each support column includes its own independent fold lock mechanism, allowing one support column to be locked in its folded configuration while the other support column remains in its support configuration. This capability may be particularly useful when an embodiment needs to be supported on highly uneven support surfaces. Alternatively, even lighter weight and a simpler design may be achieved in some embodiments where the fold lock mechanism is adapted to allow a first support column to be independently locked in folded configuration, and a second support column to be trapped in the folded position by the first support column.

When weight is placed on or within an embodiment, it is particularly important that the support columns are able to resist the tendency to spontaneously fold inward or outward from their support configurations. In some embodiments, the support columns each have an outer corner edge which is adapted to rigidly engage the body at a point in its rotation such that the support column is prevented from folding outwardly beyond its support configuration.

To help prevent a support column from undesirably folding inward from its support configuration, some embodiments include a support stiffening mechanism. This support stiffening mechanism is adapted to yieldably resist movement of its respective support column from its support configuration. One such support stiffening mechanism, for example, comprises a lock tube member with a resisting edge, the resisting edge being oriented approximately parallel to the pivot axis of its respective support column. When the respective support column is in support configuration, one or more compression springs act on the lock tube member such that the resisting edge is urged toward the lower face of the body. Because the distance between the pivot axis and the resisting edge is greater than the distance between the pivot axis and lower face of the body, initial inward rotation of the respective support column from its support configuration results in the application of compression force between the lower face of the body and the resisting edge of the lock tube member. This compression force is resisted by the compression springs acting on the respective lock tube member. The spring force provided by the compression springs thereby initially yieldably resists inward movement of the respective support column from it support configuration. The degree of yieldable resistance provided by the support stiffening mechanism can be selected by choosing compression springs of various spring constants during the design or manufacturing phases. Additionally, some embodiments allow the consumer to adjust the compression spring force themselves (for example, by manipulating a preload adjuster), in order to optimize the stiffness of the support stiffening mechanism to suit their particular needs or preferences.

Certain embodiments with at least one fold lock mechanism and at least one support stiffening mechanism achieve greater mechanical efficiency and lighter weight by having the two mechanisms mechanically ganged to one another.

To provide an added measure of safety, one or both support columns of some embodiments further include a load sensor system. This load sensor system is adapted, for example, to provide a warning signal when the extendable section of its respective support column is in extended configuration and a compression force in excess of a predetermined amount is applied between the fixed length section and the elongated foot section of its respective support column in a direction generally perpendicular to the pivot axis about which its respective support column rotates. The warning signal can be, for example, audible like a buzzer, or visual like a flashing LED.

The detailed description of embodiments of the configurable briefcase desktop is intended to serve merely as example, and is in no way intended to limit the scope of the appended claims to these described embodiments. Accordingly, modifications to the embodiments described are possible, and it should be clearly understood that the invention may be practiced in many different ways than the embodiments specifically described below, and still remain within the scope of the claims.

BRIEF DESCRIPTION OF SEVERAL VIEWS OF THE DRAWINGS

Further advantages of the present invention may become apparent to those skilled in the art with the benefit of the following detailed description of the preferred embodiments and upon reference to the accompanying drawings in which:

FIG. 4 is a diagrammatic side view of an embodiment of FIG. 1;

FIG. 5 is a diagrammatic enlarged partial view of detail 5 of FIG. 4;

FIG. 6 is a diagrammatic isometric view depicting an embodiment of FIG. 1 showing the scissors linkages of each extendable section in a partially retracted configuration;

FIG. 7 is a diagrammatic isometric view of an embodiment of FIG. 1 showing the scissors linkages of each extendable section in retracted configuration;

FIG. 8 is a diagrammatic isometric view, shown from another angle, of an embodiment of FIG. 1 configured as in FIG. 7;

FIG. 9 is a diagrammatic enlarged partial view of detail 9 of FIG. 8;

FIG. 12 is a diagrammatic isometric view of an embodiment of FIG. 1 showing one support column in support configuration, the other support column in folded configuration and the scissors linkages of the extendable sections of both support columns in retracted configuration;

FIG. 13 is a diagrammatic isometric view of an embodiment of FIG. 1 showing both support columns locked in folded configuration;

FIG. 14 is a diagrammatic isometric view of an embodiment of FIG. 1 with both support columns locked in folded configuration and the embodiment in handle carry orientation;

FIG. 23 is an enlarged cross-sectional view taken along lines 23-23 of FIG. 21;

FIG. 24 is an enlarged fragmentary cross-sectional view taken along lines 24-24 of FIG. 22;

Figure 1:
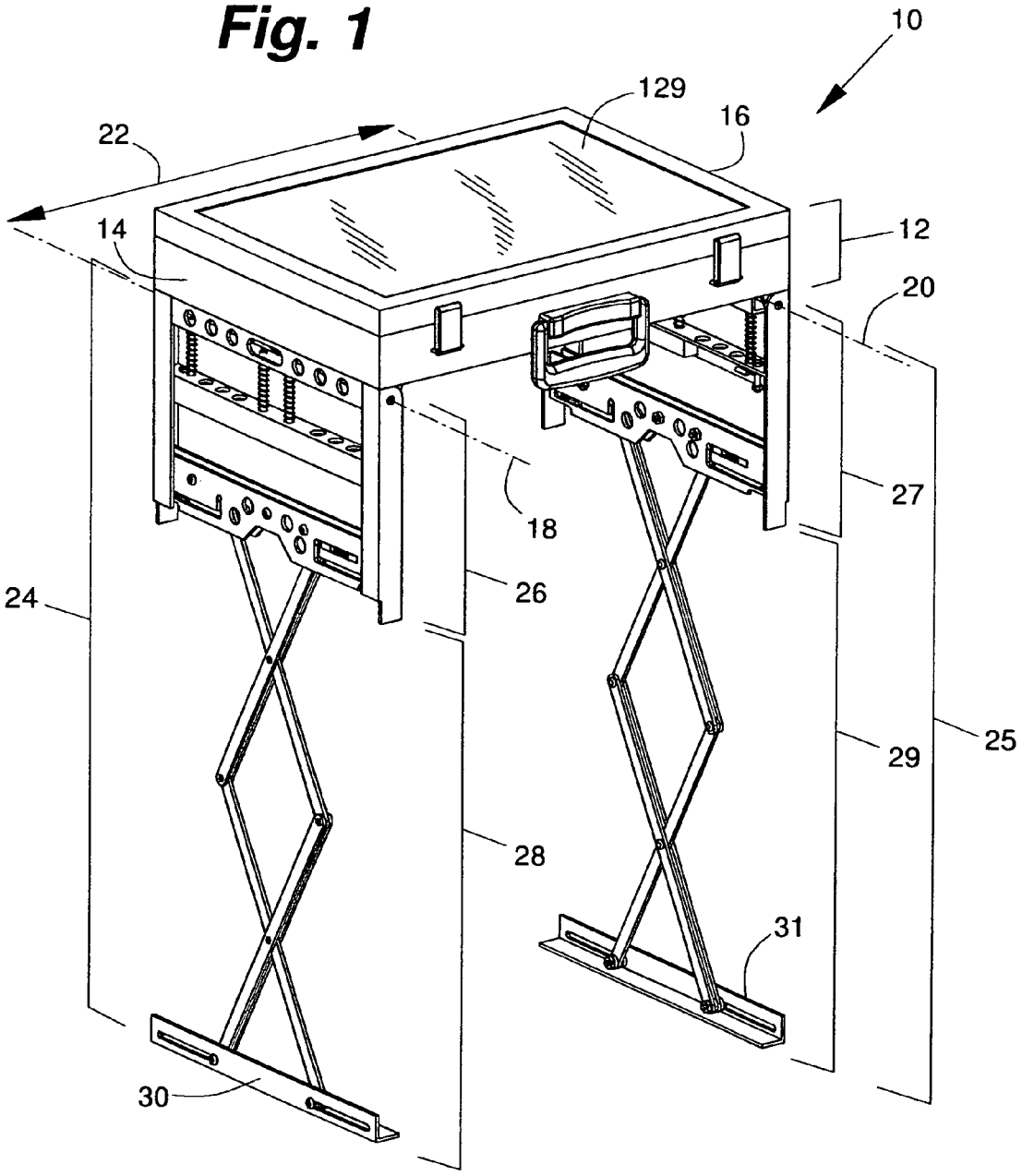
FIG. 1 is a diagrammatic isometric view depicting an embodiment of a configurable briefcase desktop wherein the fixed length sections of each support column are in unfolded configuration and the extendable section of each support column are in extended configuration.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications.

DETAILED DESCRIPTION OF THE INVENTION

The following description of preferred embodiments generally relates to briefcase desktops which include support columns configurable to optimize the support height and portability of the embodiment. In certain embodiments, for added safety, one or more load sensor systems are provided to alert a user when one or both support columns are being subjected to support loads in excess of a predefined value. Certain embodiments include a fold lock mechanism to releasably lock each of the support columns in their respective folded configurations. Additionally, certain embodiments include a support stiffening mechanism associated with each of the support columns which yieldably resists movement of the respective support column from its support configuration. The same or similar elements that appear in different Figures have been assigned the same reference numbers for purpose of ease of understanding.

Figure 17:
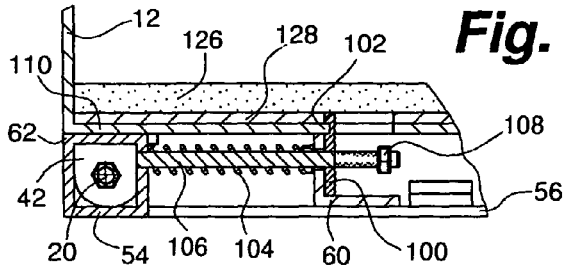
FIG. 17 is an enlarged fragmentary section view taken along lines 17-17 of FIG. 13.

Referring particularly to the Figures in the accompanying drawings for the purposes of illustration of the best mode only, and not limitation, there is illustrated generally at 10 (see, for example, FIGS. 1-3) a body 12 including two spaced apart generally opposed sides, herein shown for example as first side 14 and second side 16. First side 14 has an associated first pivot axis 18, and second side 16 has an associated second pivot axis 20. First pivot axis 18 and second pivot axis 20 each extend generally parallel to one another and are spaced apart from one another by a distance 22. Body 12 generally includes a storage cavity 32 (see, for example, FIGS. 2, 23 and 24), being readily accessible by way of, for example, a hinge associated between a lid and a base portion of body 12. The lid portion of body 12 can remain in an upright, open configuration as depicted in FIG. 2 by way of, for example, linkages or sufficient friction within hinge 33. Top plate 129 is made of a supportive and resilient material such as aluminum or, if transparency is desired, Plexiglas® for example. Body 12 and storage cavity 32 are generally of sufficient size and volume to accommodate a typical laptop computer and related components, but may be larger or smaller depending on the particular contents to be stored and transported. A foam layer 126 is generally provided to help insulate the contents of storage cavity 32 from exposure to shock and moisture. The weight of objects placed within the storage cavity 32 is supported by bottom plate 128 (see, for example, FIG. 17).

Returning to FIG. 1, embodiments of a configurable briefcase desktop further comprise two support columns, herein depicted, for example, as first support column 24 and second support column 25, each being generally planar. In the embodiment chosen for illustration, first support column 24 is pivotally mounted to mounting brackets 42 using mounting bolts 44 (see, for example, FIG. 3) for rotation generally around first pivot axis 18. Second support column 25 is similarly pivotally mounted for rotation generally around second pivot axis 20. Support column 24 extends generally parallel to first pivot axis 18, and support column 25 extends generally parallel to second pivot axis 20. Turning to FIG. 12, each of support columns 24 and 25 are adapted to being rotated between, for example, a folded configuration 122 and a support configuration 120.

Figure 2:
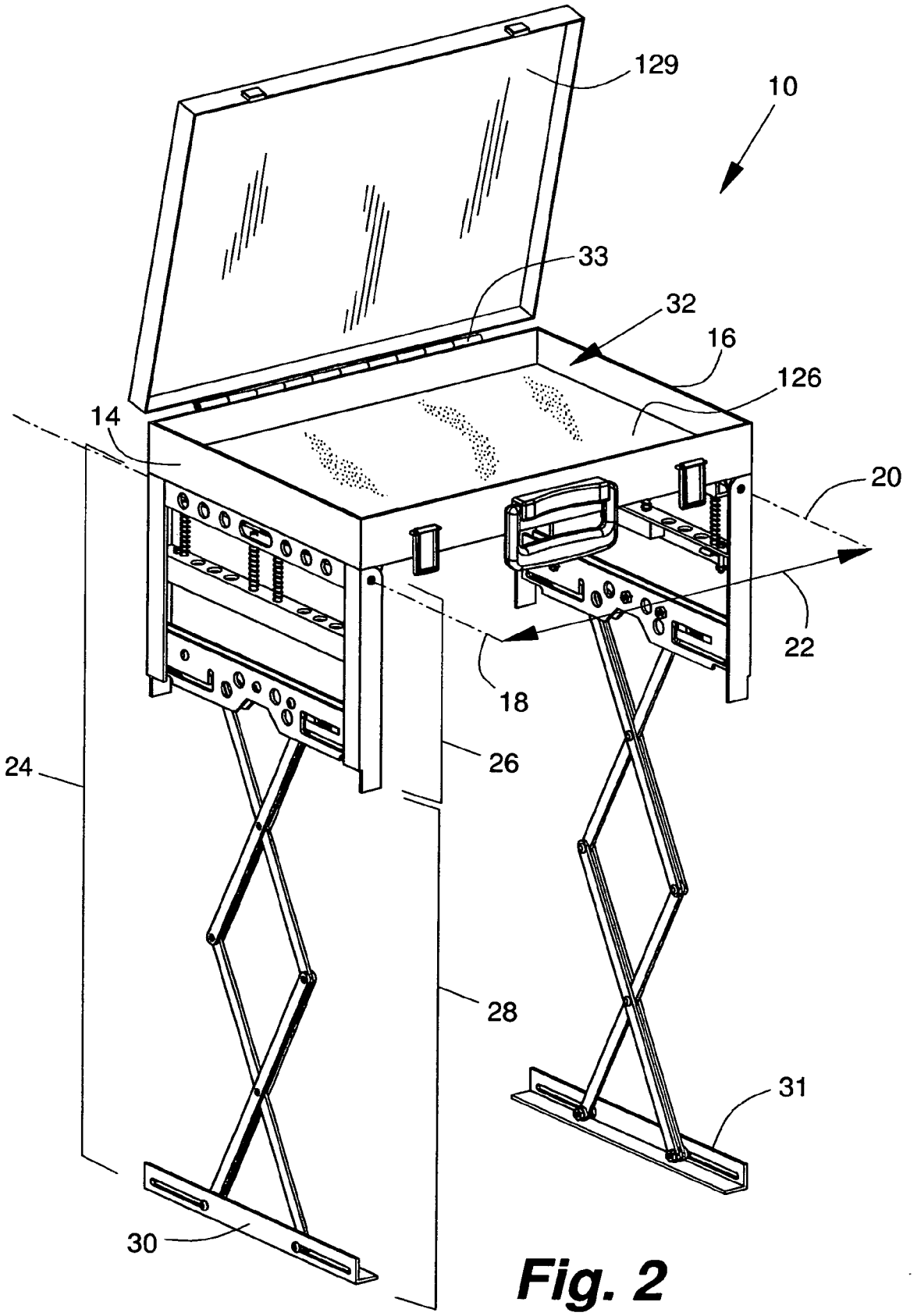
FIG. 2 is a diagrammatic isometric view of an embodiment of FIG. 1 further illustrating the accessibility of the cavity within the body.
Figure 3:
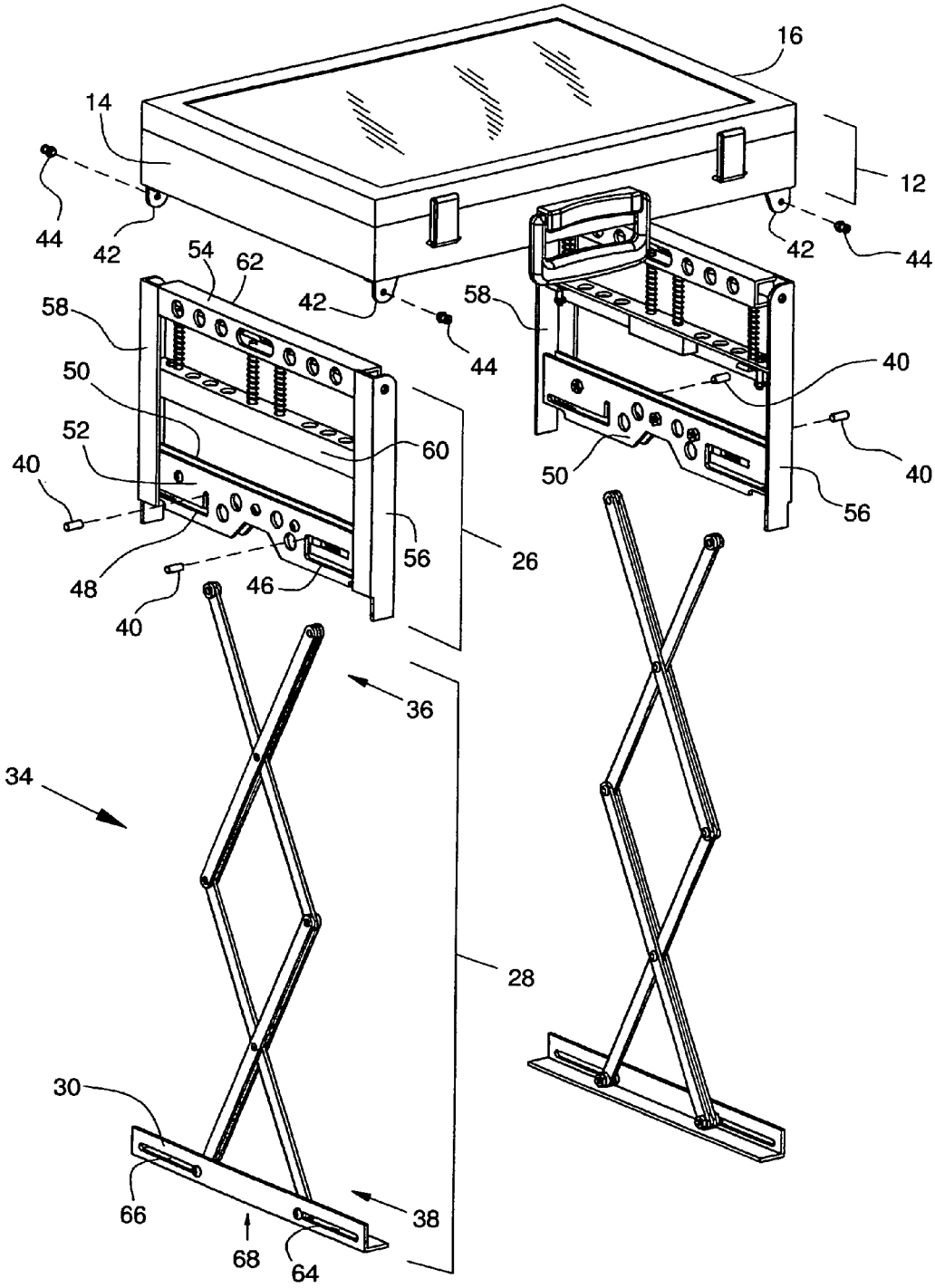
FIG. 3 is a diagrammatic exploded view of an embodiment of FIG. 1.

Turning now to FIGS. 1 and 3, first support column 24 and second support column 25 include, respectively, first fixed length section 26 and second fixed length section 27, and first extendable section 28 and second extendable section 29. Referring to FIGS. 3 and 6, first extendable section 28 and second extendable section 29 each independently comprise a scissors linkage, shown generally at 34. Each scissors linkage 34 is adapted to extend between a retracted configuration (see, for example, in FIG. 7) and an extended configuration (see, for example, in FIG. 4). Each scissors linkage 34 is further adapted to extend generally parallel to its respective support column and generally perpendicular to the pivot axis about which its respective support column rotates.

Figure 11:
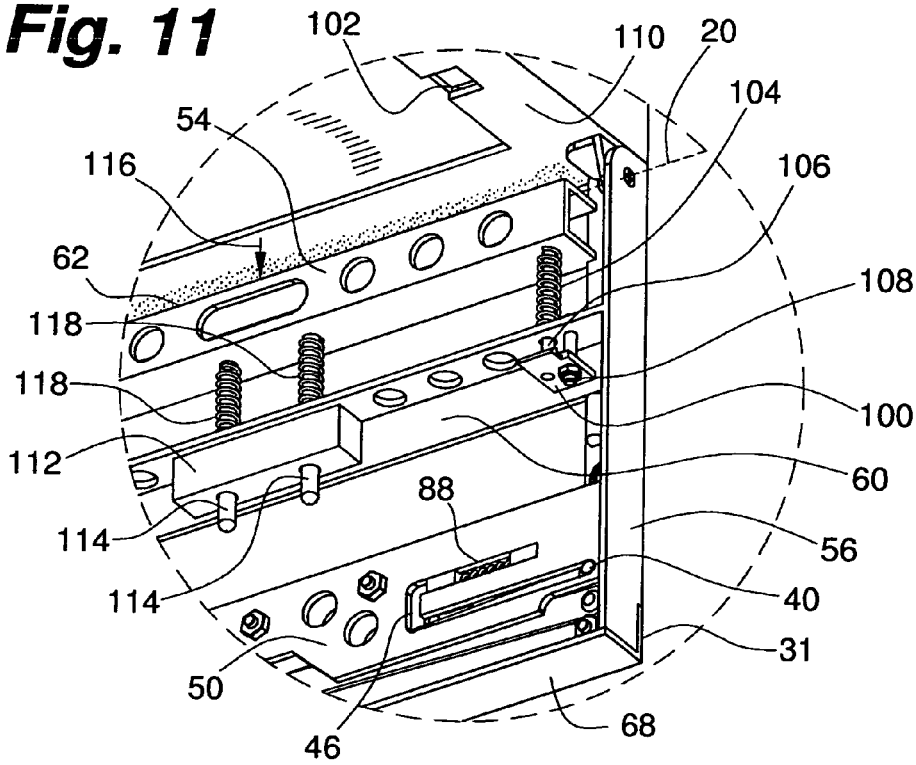
FIG. 11 is a diagrammatic enlarged partial view of detail 11 of FIG. 10.
Figure 15:
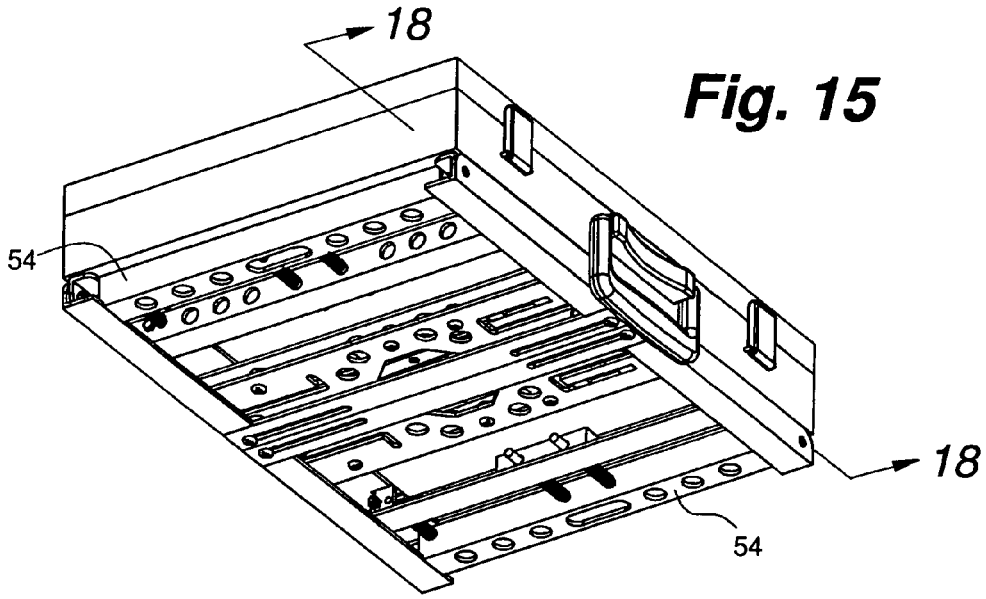
FIG. 15 is a diagrammatic isometric view similar to FIG. 13, but with both lock tubes in compressed position, indicating disengagement of the fold lock mechanisms and support stiffening mechanisms of both support columns.
Figure 16:
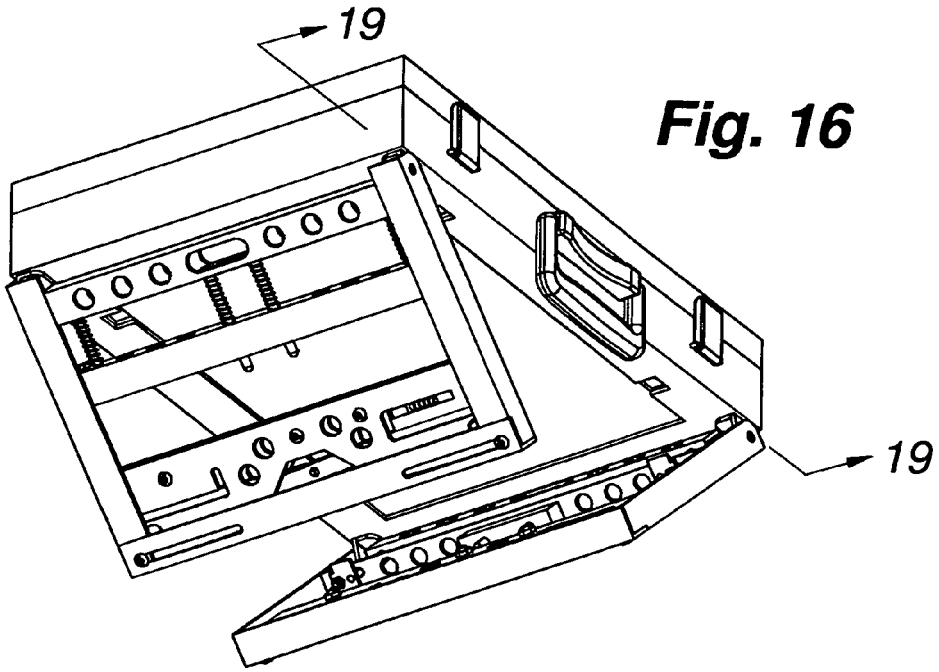
FIG. 16 is a diagrammatic isometric view showing both support columns in partially folded configuration with both lock tubes in compressed position.

As illustrated in FIG. 3, in the embodiment chosen for illustration, first fixed length section 26 and second fixed length section 27 each comprise a first frame member 56, second frame member 58, inner channel plate 50, outer channel plate 52, and cross member 60, their respective joints being generally fixed by welding, riveting, or nuts and bolts. Each inner channel plate 50 and outer channel plate 52 include a front guide channel 46 and a rear guide channel 48, and both of which are spaced apart by plate spacers 146 (see, for example, FIG. 25). Lock tube member 54 is slidably associated with first frame member 56 and second frame member 58, and, as illustrated in FIG. 11, fixedly associated with guide rods 114 and lock rod elements 106. Guide block 112 is fixedly associated with cross member 60, and is guidingly associated with guide rods 114. Compression springs 118 and lock springs 104 yieldably resist movement of lock tube 54 in compression direction 116 (Also see FIGS. 15 and 18 for movement of lock tube 54 in compression direction 116).

Figure 18:
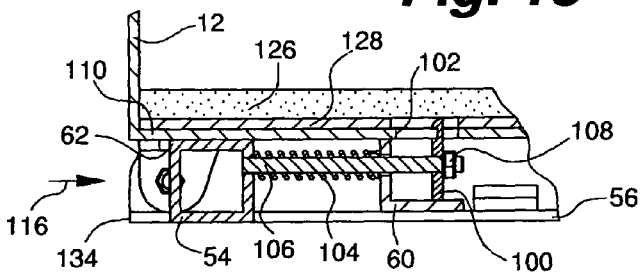
FIG. 18 is an enlarged fragmentary section view taken along lines 18-18 of FIG. 15.
Figure 19:
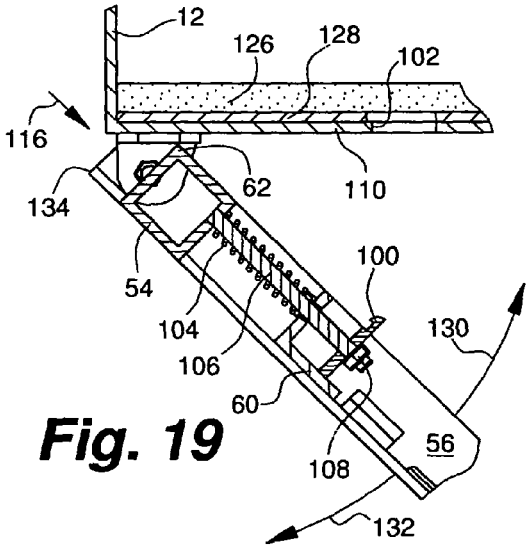
FIG. 19 is an enlarged fragmentary section view taken along lines 19-19 of FIG. 16.
Figure 20:
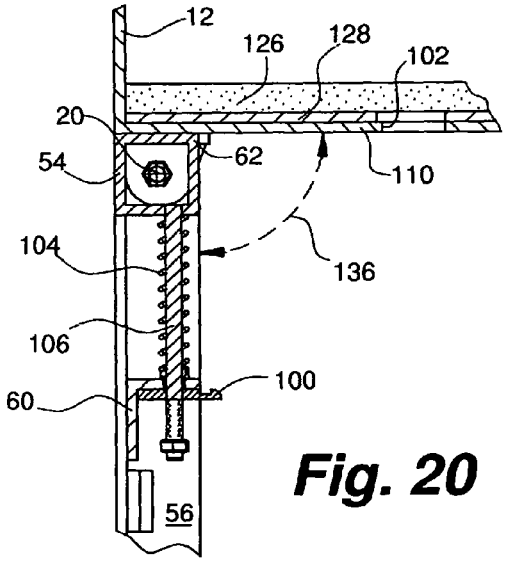
FIG. 20 is an enlarged fragmentary section view taken along lines 20-20 of FIG. 12.

Turning to FIGS. 7, 12 and 13, when a scissors linkage 34 is in a fully retracted configuration its respective support column has an overall length that is no more than approximately one-half of distance 22 (see FIG. 1 for distance 22). When both of said support columns 24 and 25 are in fully folded and fully retracted configurations said respective support columns are generally located in approximately a common plane (see FIG. 13 in particular). Whereas when said support columns 24 and 25 are both in their respective support configurations, as illustrated in both FIG. 1 and FIG. 7, they extend generally parallel to one another and are spaced apart by at least approximately distance 22. Turning to FIGS. 12 and 20, when a support column is in its respective support configuration 120, support angle 136 between the lower face 110 of body 12 and the plane of the support column is typically approximately 90 degrees. However, some embodiments may find increased lateral stability with support angle 136 being set to greater than 90 degrees. Turning to FIGS. 18-20, as the respective support column is rotated in the outward direction 132 toward its support configuration 120, rigid engagement between corner edge 134 and lower face 110 prevents the predefined support angle 136 from being exceeded.

Returning now to FIGS. 1 and 2, first extendable section 28 and second extendable section 29 further comprise a first elongated foot member 30 and a second elongated foot member 31, respectively. First elongated foot member 30 and second elongated foot member 31 each include a bottom surface 68 (shown generally in FIGS. 3, 10 and 11) adapted to distribute the weight of an entire embodiment, its contents and items it supports, across a larger surface area in order to reduce stress concentrations applied to the support surface 138 (see FIGS. 21 and 22 for support surface 138). As illustrated generally in FIG. 3, each of scissor linkages 34 includes a first end 36 and a second end 38. In the embodiment chosen for illustration, first end 36 of each scissors linkage 34 is operatively joined to their respective fixed length sections using upper channel pins 40. Second end 38 is connectedly associated with the elongated foot element of its respective extendable section at front foot channel 64 and rear foot channel 66.

Turning Now to FIGS. 4 and 5, when a scissors linkage 34 is in its extended configuration, upper channel pin 40 within rear guide channel 48, and upper channel pin 40 within front guide channel 46 can be moved in upward direction 70 from their respective rear second position 98 and front second position 96, into their respective support positions (as they are shown in FIG. 5). When the upper channel pin 40 within rear guide channel 48 is in its support position (as it is shown in FIG. 5), it is prevented from moving in forward direction 74 or rearward direction 76. Whereas when upper channel pin 40 within front guide channel 46 is in its support position (as it is shown in FIG. 5), it is prevented from moving in rearward direction 76, but can move in forward direction 74 against slider 78 and the compression force of sensor spring 84.

Figure 21:
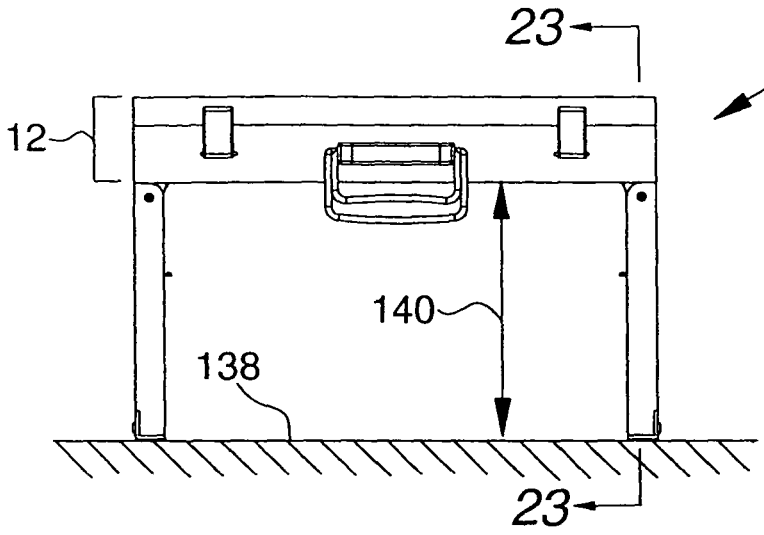
FIG. 21 is a diagrammatic front view of an embodiment of FIG. 1 showing both support columns in support configuration, and a distance between the body and support surface when the scissor linkages of both support columns are in retracted configuration.
Figure 22:
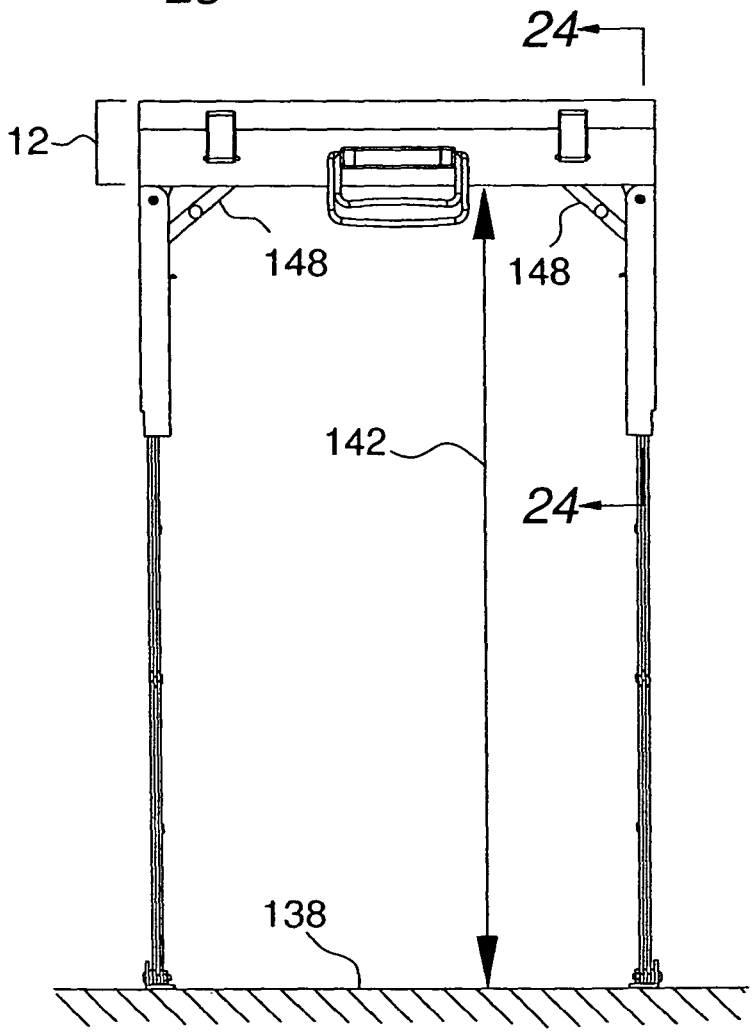
FIG. 22 is a diagrammatic front view of an embodiment of FIG. 1 showing both support columns in support configuration, and a distance between the body and support surface when the scissor linkages of both support columns are in extended configuration.

FIG. 21 depicts the embodiment chosen for illustration wherein both support columns are in support configuration and both scissors linkages are in retracted configuration, resulting in body 12 being supported at a first height 140 from support surface 138. FIG. 22 depicts the same embodiment as FIG. 21 wherein both support columns are in support configuration and both scissors linkages are in extended configuration, resulting body 12 being supported at a second height 142 from support surface 138. Second height 142 is greater than first height 140.

Figure 10:
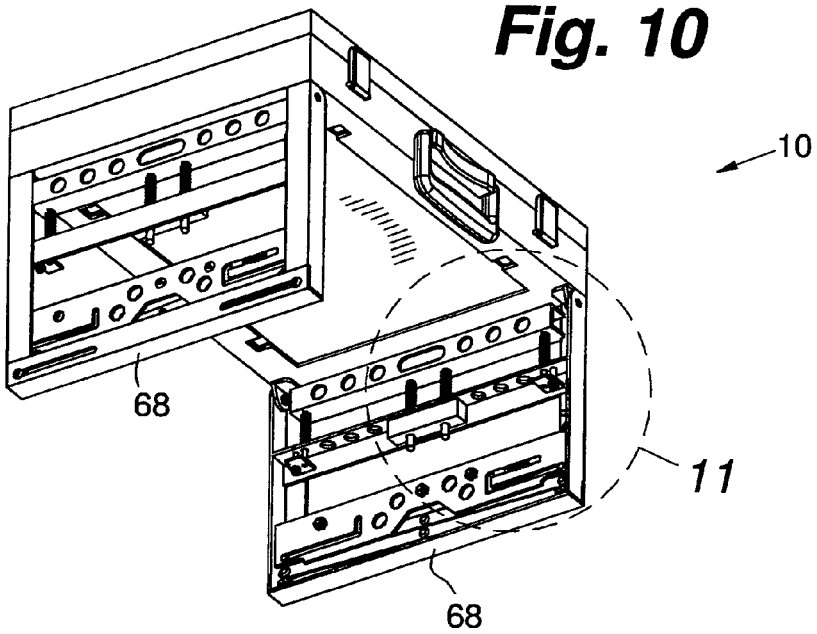
FIG. 10 diagrammatically depicts an embodiment of FIG. 1 showing each support column in support configuration, the extendable sections of each support column in retracted configuration and the lock tube members in their compressed positions.

Turning to FIGS. 10 and 11, certain embodiments include at least one fold lock mechanism adapted to releasably lock its respective support column in folded configuration. Turning to FIGS. 17-20 for greater detail, lock member 100 is positioned such that when its respective support column is moved in inward rotation 130 toward folded configuration 122, lock member 100 will engage lock engaging portion 102, thereby preventing its respective support column from leaving its folded configuration until the user has reversed the engagement by pressing the lock tube member 54 in compression direction 116 against the force of compression springs 118 and lock springs 104. Travel limiting element 108 limits the movement of lock member 100 in compression direction 116. In the embodiment chosen for illustration, each support column includes two lock members 100 and two lock engaging portions 102. To unlock a support column from locked in its folded configuration 122, the user simply compresses lock tube 54 in compression direction 116 (see, for example, FIGS. 15, 16, 18, 19).

Turning now to FIGS. 19 and 20, certain embodiments include one or more support stiffening mechanisms to yieldably resist movement of a support column from its support configuration 120 toward inward direction 130. In the embodiment chosen for illustration, the force imposed on lock tube member 54 by springs 104 and compression springs 118 urges resisting edge 62 toward lower face 110. By way of example, because the distance between pivot axis 20 and resisting edge 62 is greater than the distance between the pivot axis 20 and lower face of the body, initial inward rotation 130 of the respective support column from its support configuration 120 results in the application of compression force, in the opposite direction of compression direction 116, between the lower face 110 of the body 12 and the resisting edge 62. The spring force provided by the compression springs thereby initially yieldably resists inward movement of the respective support column from it support configuration. The degree of yieldable resistance provided by the support stiffening mechanism can be selected by choosing compression springs 118 and lock springs 104 of various spring constants during the design or manufacturing phases. Additionally, by including, for example, a preload adjuster, some embodiments allow the consumer to adjust the compression spring force themselves to optimize the stiffness of the support stiffening mechanism to suit their particular needs or preferences.

Figure 25:
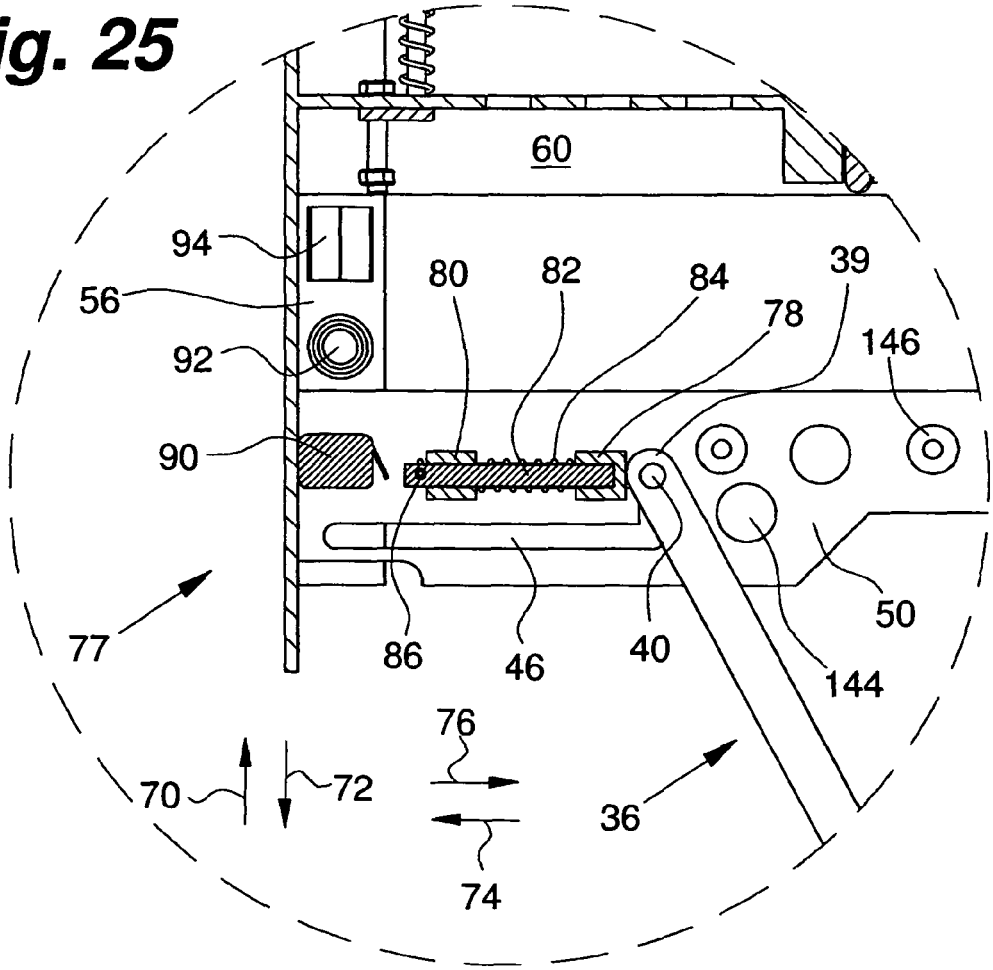
FIG. 25 is a diagrammatic enlarged partial view of detail 25 of FIG. 24.

Illustrated generally in FIG. 24, and in greater detail in FIG. 25, is a load sensor system 77. Slider 78 is fixed to shaft 82 and acts to guide shaft 82 along slider segment 88 (FIG. 11) of front guide channel 46 in forward direction 74 and rearward direction 76. Shaft 82 is able to slide through shaft guide 80, which is in generally fixed association with front guide channel 46. Sensor spring 84 is a preloaded compression spring which urges slider 78 and shaft 82 in the rearward direction 76. Clip member 86 prevents shaft 82 from exiting shaft guide 80 in rearward direction 76. Forward terminal 39 is the portion of first end 36 of scissor linkage 34 that is slidably engaged with front guide channel 46. When scissors linkage 34 is in its extended configuration and the weight of the embodiment is resting on the scissors linkage 34, forward terminal 39 rests in contact with slider 78. Movement of scissors linkage 34 toward a retracted configuration causes forward terminal 39 to move in forward direction 74. The physical properties of sensor spring 84 are selected to provide enough compression force to prevent forward terminal 39 from pushing shaft 82 into engagement with microswitch 90 when the compression force being applied between the respective fixed length section and respective elongated foot member is within predetermined safe limits. However, when that compression force exceeds this safe limit, the spring force of sensor spring 84 is overcome such that shaft 82 is pushed into engagement with microswitch 90, thereby setting off a warning signal from speaker element 92 using power from battery 94. Microswitch 90, speaker element 92 and battery 94 are electrically connected with each other (not shown). Certain embodiments may include a load sensor system, as described for example herein, for one or both support columns. In addition, as one of ordinary skill in the mechanical arts could construe from the figures and description provided herein, in further embodiments, one or both rear guide channels 48 can be formed similarly to the front guide channels 46 depicted in FIG. 5, so as to accommodate a load sensor system 77 in addition to or in place of those presently shown in association with front guide channels 46.

As with the embodiment chosen for illustration, certain embodiments with at least one fold lock mechanism and at least one support stiffening mechanism achieve greater mechanical efficiency and lighter weight by having the two mechanisms mechanically ganged to one another. Small lockout linkages 148 (as depicted, for example, in FIG. 22) can be employed in certain embodiments to provide additional lateral stability, particularly when support columns 24 and 25 are in support configuration and both scissors linkages 34 are in extended configuration. Lockout linkages 148 are retracted when their respective support columns are in folded configuration. Lockout linkages 148 can be employed at either first frame member 56, second frame member 58, or both. Lightening holes 144 (see, for example, FIG. 25) are provided throughout to reduce the weight of the embodiment and therefore improve portability. FIG. 14 depicts an embodiment with support columns in their respective folded configurations, and the embodiment ready to be carried using the handle 124.

The foregoing detailed description of the invention is intended to be illustrative and is not intended to limit the scope of the invention. Changes and modifications are possible with respect to the embodiments detailed in the foregoing description, and it is understood that the invention may be practiced otherwise than that specifically described herein and still be within the scope of the appended claims.

The invention claimed is:

1. A configurable briefcase desktop, comprising:

a body, said body including two spaced apart generally opposed sides, each of said opposed sides having a pivot axis associated therewith, said pivot axes extending generally parallel to one another and being spaced apart from one another by a distance, a storage cavity, said storage cavity being readily accessible; and two support columns, each said support column being generally planar, each said support column being pivotally mounted for rotation generally around one of said pivot axes, each of said support columns extending generally parallel to the said pivot axis to which it is pivotally mounted, said support columns adapted to being rotated between a folded configuration and a support configuration, each of said support columns including a fixed length section and an extendable section, each of said extendable sections being comprised of a scissors linkage adapted to extend between retracted and extended configurations, each of said scissors linkages being adapted to extend generally parallel to its respective said support column and generally perpendicular to the said pivot axis about which its respective said support column rotates, wherein when a said scissors linkage is in a fully retracted configuration its respective support column has an overall length that is no more than approximately one-half of said distance, when both of said support columns are in fully folded and fully retracted configurations said respective support columns are generally located in approximately a common plane, and when said support columns are both in said support configuration they extend generally parallel to one another and are spaced apart by at least approximately said distance, each of said extendable sections further comprising an elongated foot element and each of said scissors linkages including a first end and a second end, said elongated foot element being adapted to rest on a generally flat surface, said first end being operably joined to said fixed length section of its respective said support column and said second end being connectedly associated with said elongated foot element of its respective said extendable section, each said support column further including a fold lock mechanism and support stiffening mechanism, said fold lock mechanism being adapted to releasably lock its respective said support column in said folded configuration, said support stiffening mechanism being adapted to yieldably resist movement of its respective said support column from said support configuration, said support column being further adapted such that its respective said fold lock mechanism and its respective said support stiffening mechanism are mechanically ganged to one another.

2. A configurable briefcase desktop of claim 1 wherein at least one of said support columns further includes a load sensor system, said load sensor system being adapted to provide a warning signal when said extendable section of its respective said support column is in said extended configuration and a compression force in excess of a predetermined amount is applied between said fixed length section and said elongated foot member of its respective said support column in a direction generally perpendicular to the said pivot axis about which its respective said support column rotates.

3. A configurable briefcase desktop, comprising:

a body, said body including two spaced apart generally opposed sides, each of said opposed sides having a pivot axis associated therewith, said pivot axes extending generally parallel to one another and being spaced apart from one another by a distance, a storage cavity, said storage cavity being readily accessible; and two support columns, each said support column being generally planar, each said support column being pivotally mounted for rotation generally around one of said pivot axes, each of said support columns extending generally parallel to the said pivot axis to which it is pivotally mounted, said support columns adapted to being rotated between a folded configuration and a support configuration, each of said support columns including a support stiffening mechanism adapted to yieldably resist movement of its respective said support column from said support configuration, each of said support columns including a fixed length section and an extendable section, each of said extendable sections being comprised of a scissors linkage adapted to extend between retracted and extended configurations, each of said scissors linkages being adapted to extend generally parallel to its respective said support column and generally perpendicular to the said pivot axis about which its respective said support column rotates, wherein when a said scissors linkage is in a fully retracted configuration its respective support column has an overall length that is no more than approximately one-half of said distance, when both of said support columns are in fully folded and fully retracted configurations said respective support columns are generally located in approximately a common plane, and when said support columns are both in said support configuration they extend generally parallel to one another and are spaced apart by at least approximately said distance.

4. A new configurable briefcase desktop, comprising:

a body, said body including two spaced apart generally opposed sides, each of said opposed sides having a pivot axis associated therewith, said pivot axes extending generally parallel to one another and being spaced apart from one another by a distance, a storage cavity, said storage cavity being readily accessible; and two support columns, each said support column being generally planar, each said support column being pivotally mounted for rotation generally around one of said pivot axes, each of said support columns extending generally parallel to the said pivot axis to which it is pivotally mounted, said support columns adapted to being rotated between a folded configuration and a support configuration, each of said support columns including a support stiffening mechanism adapted to yieldably resist movement of its respective said support column from said support configuration, each of said support columns including fold lock mechanism adapted to releasably lock its respective said support column in said folded configuration, each of said support columns including a fixed length section and an extendable section, each of said extendable sections being comprised of a scissors linkage adapted to extend between retracted and extended configurations, each of said scissors linkages being adapted to extend generally parallel to its respective said support column and generally perpendicular to the said pivot axis about which its respective said support column rotates, wherein when a said scissors linkage is in a fully retracted configuration its respective support column has an overall length that is no more than approximately one-half of said distance, when both of said support columns are in fully folded and fully retracted configurations said respective support columns are generally located in approximately a common plane, and when said support columns are both in said support configuration they extend generally parallel to one another and are spaced apart by at least approximately said distance.

5. A configurable briefcase desktop of claim 4 wherein said support column is further adapted such that its respective said fold lock mechanism and respective said support stiffening mechanism are mechanically ganged to one another.

6. A configurable briefcase desktop, comprising:

a body, said body including two spaced apart generally opposed sides, each of said opposed sides having a pivot axis associated therewith, said pivot axes extending generally parallel to one another and being spaced apart from one another by a distance, a storage cavity, said storage cavity being readily accessible; and two support columns, each said support column being generally planar, each said support column being pivotally mounted for rotation generally around one of said pivot axes, each of said support columns extending generally parallel to the said pivot axis to which it is pivotally mounted, said support columns adapted to being rotated between a folded configuration and a support configuration, each of said support columns including a fixed length section and an extendable section, each of said extendable sections being comprised of a scissors linkage adapted to extend between retracted and extended configurations, each of said scissors linkages being adapted to extend generally parallel to its respective said support column and generally perpendicular to the said pivot axis about which its respective said support column rotates, wherein when a said scissors linkage is in a fully retracted configuration its respective support column has an overall length that is no more than approximately one-half of said distance, when both of said support columns are in fully folded and fully retracted configurations said respective support columns re generally located in approximately a common plane, and when said support columns re both in said support configuration they extend generally parallel to one another and are spaced apart by at least approximately said distance, at least one of said support columns further including a load sensor system, said load sensor system being adapted to provide a warning signal when said extendable section of its respective said support column is in said extended configuration and a compression force in excess of a predetermined amount is applied between said fixed length section and said elongated foot member of its respective said support column in a direction generally perpendicular to the said pivot axis about which its respective said support column rotates.

7. A configurable briefcase desktop, comprising:

a body, said body including two spaced apart generally opposed sides, each of said opposed sides having a pivot axis associated therewith, said pivot axes extending generally parallel to one another and being spaced apart from one another by a distance, a storage cavity, said storage cavity being readily accessible; and two support columns, each said support column being generally planar, each said support column being pivotally mounted for rotation generally around one of said pivot axes, each of said support columns extending generally parallel to the said pivot axis to which it is pivotally mounted, said support columns adapted to being rotated between a folded configuration and a support configuration, each of said support columns including a fold lock mechanism adapted to releasably lock its respective said support column in said folded configuration, each of said support columns further including a fixed length section and an extendable section, each of said extendable sections being comprised of a scissors linkage adapted to extend between retracted and extended configurations, each of said scissors linkages being adapted to extend generally parallel to its respective said support column and generally perpendicular to the said pivot axis about which its respective said support column and generally perpendicular to the said pivot axis about which its respective said support column rotates, wherein when a said scissors linkage is in a fully retracted configuration its respective support column has an overall length that is no more than approximately one-half of said distance, when both of said support columns are in fully folded and fully retracted configurations said respective support columns are generally located in approximately a common plane, and when said support columns are both in said support configuration they extend generally parallel to one another and are spaced apart by at least approximately said distance, each of said extendable sections is further comprising an elongated foot element and each of said scissors linkages including a first end and a second end, said elongated foot element being adapted to rest on a generally flat surface, said first end being operably joined to said fixed length section of its respective said support column and said second end being connectedly associated with said elongated foot element of its respective said extendable section.

8. A configurable briefcase desktop of claim 7 wherein each said support column further includes a support stiffening mechanism adapted to yieldably resist movement of its respective said support column from said support configuration.

9. A configurable briefcase desktop of claim 8 wherein said support column is further adapted such that its respective said fold lock mechanism and its respective said support stiffening mechanism are mechanically ganged to one another.

10. A configurable briefcase desktop of claim 8 wherein at least one of said support columns further includes a load sensor system, said load sensor system being adapted to provide a warning signal when said extendable section of its respective said support column is in said extended configuration and a compression force in excess of a predetermined amount is applied between said fixed length section and said elongated foot member of its respective said support column in a direction generally perpendicular to the said pivot axis about which its respective said support column rotates.

11. A configurable briefcase desktop of claim 9 wherein at least one of said support columns further includes a load sensor system, said load sensor system being adapted to provide a warning signal when said extendable section of its respective said support column is in said extended configuration and a compression force in excess of a predetermined amount is applied between said fixed length section and said elongated foot member of its respective said support column in a direction generally perpendicular to the said pivot axis about which its respective said support column rotates.

12. A configurable briefcase desktop, comprising:

a body, said body including two spaced apart generally opposed sides, each of said opposed sides having a pivot axis associated therewith, said pivot axes extending generally parallel to one another and being spaced apart from one another by a distance, a storage cavity, said storage cavity being readily accessible; and two support columns, each said support column being generally planar, each said support column being pivotally mounted for rotation generally around one of said pivot axes, each of said support columns extending generally parallel to the said pivot axis to which it is pivotally mounted, said support columns adapted to being rotated between a folded configuration and a support configuration, each of said support columns further including a fold lock mechanism adapted to releasably lock its respective, said support column in said folded configuration and a support stiffening mechanism adapted to yieldably resist movement of its respective said support column from said support configuration and wherein said support column is further adapted such that its respective said fold lock mechanism and its respective said support stiffening mechanism are mechanically gauged to one another, each of said support columns including a fixed length section and an extendable section, each of said extendable sections being comprised of a scissors linkage adapted to extend between retracted and extended configurations, each of said scissors linkages being adapted to extend generally parallel to its respective said support column and generally perpendicular to the said pivot axis about which its respective said support column rotates, wherein when a said scissors linkage is in a fully retracted configuration its respective support column has an overall length that is no more than approximately one-half of said distance, when both of said support columns are in fully folded and fully retracted configurations said respective support columns are generally located in approximately a common plane, and when said support columns are both in said support configuration they extend generally parallel to one another and are spaced apart by at least approximately said distance, each of said extendable sections further comprising an elongated foot element and each of said scissors linkages including a first end and a second end, said elongated foot element being adapted to rest on a generally flat surface, said first end being operably joined to said fixed length section of its respective said support column and said second end being connectedly associated with said elongated foot element of its respective said extendable section.

13. A configurable briefcase desktop of claim 12 wherein at least one of said support columns further includes a load sensor system, said load sensor system being adapted to provide a warning signal when said extendable section of its respective said support column is in said extended configuration and a compression force in excess of a predetermined amount is applied between said fixed length section and said elongated foot member of its respective said support column in a direction generally perpendicular to the said pivot axis about which its respective said support column rotates.

* * * * *